US005806748A

United States Patent [19]

Lee

[11] Patent Number: 5,806,748

[45] Date of Patent: Sep. 15, 1998

[54] EJECTION SWITCH FOR NAILER

[76] Inventor: Yun-Chung Lee, 3F No. 117, Yuchoko Tan Shui Jen, Taipei Hsien, Taiwan

[21] Appl. No.: 984,375

[22] Filed: Dec. 3, 1997

[51] Int. Cl.[6] ..... B25C 1/04

[52] U.S. Cl. ..... 227/130

[58] Field of Search ..... 227/8, 130

[56] References Cited

U.S. PATENT DOCUMENTS

| | | | |
|---|---|---|---|
| 4,480,528 | 11/1984 | Shiroyama | 227/130 |
| 4,509,669 | 4/1985 | Klaus et al. | 227/130 |
| 4,915,013 | 4/1990 | Moraht et al. | 227/130 |
| 5,080,273 | 1/1992 | Meyer | 227/130 |
| 5,628,444 | 5/1997 | White | 227/130 |
| 5,669,542 | 9/1997 | White | 227/130 |

*Primary Examiner*—Scott A. Smith

*Attorney, Agent, or Firm*—Pro-Techtor International Services

[57] ABSTRACT

The present invention relates to an ejection switch for a nailer, comprising a valve seat, a gliding seat and a moving bar, allowing for precise controlling of the ejection of nails. The moving bar glides vertically within a gliding seat, with a vertical position that controls a loading state and an ejection state of the ejection switch. The gliding seat glides vertically within the valve seat. After ejecting a nail and after loading for another ejection, the gliding seat respectively moves against the moving bar. Thus the triggering of the loading state and of the ejection state follows the position of the moving bar in a hysteresis-like behavior and unwanted ejection of nails is prevented.

4 Claims, 7 Drawing Sheets

EJECTION SWITCH FOR NAILER

BACKGROUND OF THE INVENTION

1. Field of the Invention

The present invention relates to an ejection switch for a nailer, particularly to an ejection switch which allows for precise controlling of the ejection of nails.

2. Description of Related Art

When working with a nailer, the quality of the work usually depends on how nails are ejected by a trigger. So controlling the movement of the ejection switch is very important. As shown in FIG. 8, a conventional ejection switch for controlling the flow of compressed air to and from a head valve of a pressure cylinder of a nailer comprises a lower valve body 1 with an air outlet 4 and an upper valve body 2 with an air inlet 5. The lower and upper valve bodies 1, 2 are connected to each other, forming a valve seat. The air inlet 5 is connected to a compressed-air path 9A. A moving bar 7 controls opening and closing of the air inlet 5 and of the air outlet 4. The lower and upper valve bodies 1, 2 enclose a cavity 3. On one side of the cavity 3, a valve opening 6 is mounted, which is connected to the head valve of the pressure cylinder. Compressed air passes through the inlet 5 of the upper valve body 2 and enters the head valve through the valve opening 6. At this time, the entrance of the pressure cylinder is closed and ejection of another nail is prepared in a loading state. When the moving bar 7 moves up, the inlet 5 of the upper valve body 2 is closed, cutting the flow of compressed air through the valve opening 6 into the head valve, at the same time opening the outlet 4 of the lower valve body 1 and releasing compressed air contained in the head valve. Then the entrance of the pressure cylinder is enabled to open and release another nail in an ejection state. After that, the moving bar 7 moves down, closing the outlet 4 of the lower valve body 1 and opening the inlet 5 of the upper valve body 2, allowing compressed air to enter the head valve, for another loading state. Although this method of controlling the ejection of nails basically works, it has the disadvantage that the moving bar 7 opens the inlet 5 and closes the outlet 4 at almost the same time. When compressed air is to be let into the head valve, the moving bar 7 needs to move down only a little. The trigger points of the moving bar 7 for the ejection state and, on its way back, for the loading state are almost the same, as shown in FIG. 9. This makes the ejection of nails not only hard to control, but also a slight, inadvertent pushing up of the moving bar 7, just after having passed the trigger point, causes a nail to be ejected into a wrong place.

For better control of the ejection of nails, an improved ejection switch has been devised, wherein the moving bar is substituted by two independent moving bar sections resulting in different trigger points for the ejection state and the loading state. However, this kind of ejection switch has a complicated structure.

SUMMARY OF THE INVENTION

The object of the present invention is to provide an ejection switch for a nailer of simple structure, which allows to control precisely the movement of the ejection of nails.

The present invention can be more fully understood by reference to the following description and accompanying drawings.

DETAILED DESCRIPTION OF THE PREFERRED EMBODIMENTS

Figure 1:
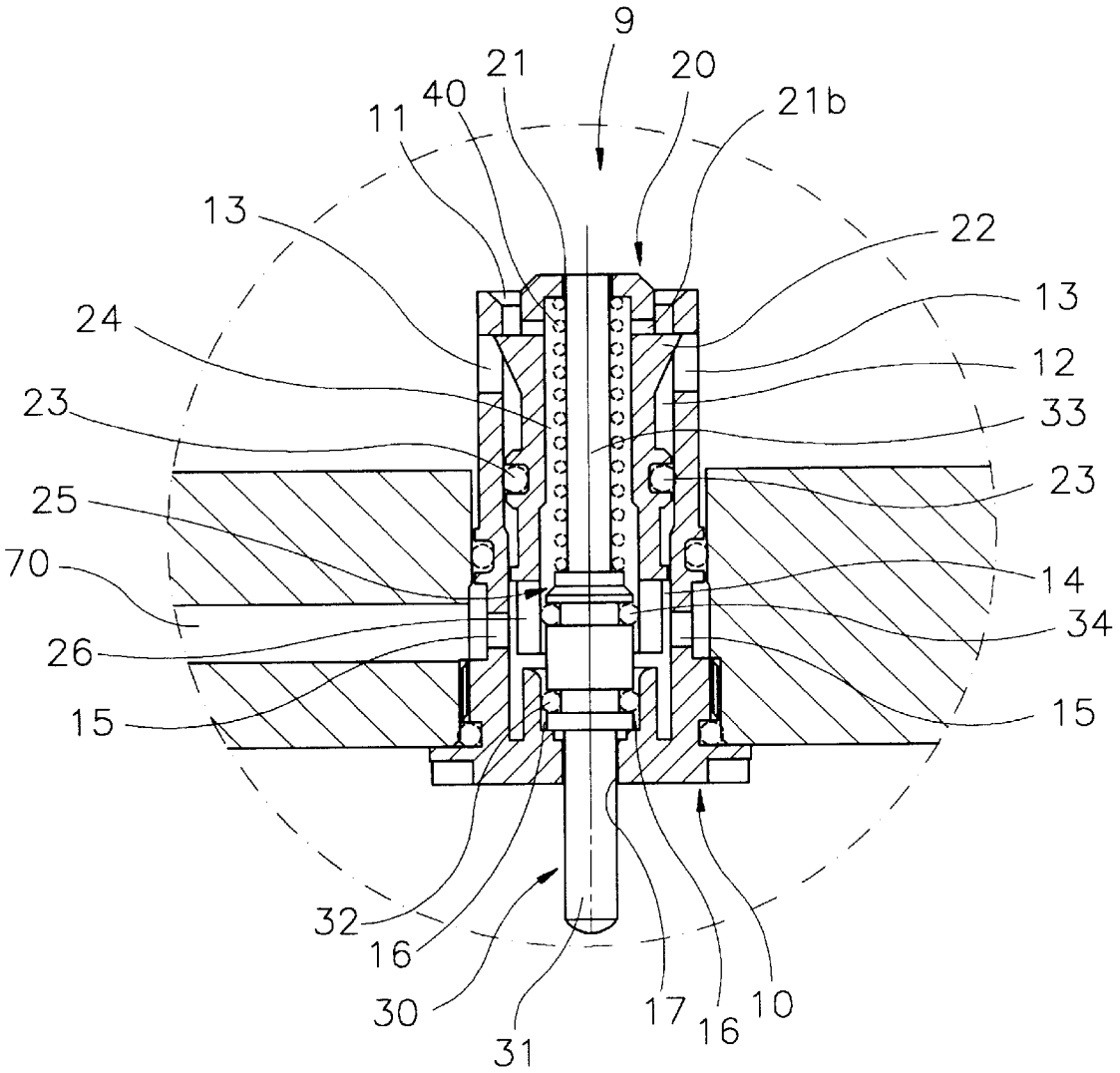
FIG. 1 is a sectional view of the present invention in the loading state, showing the assembly of the structural parts thereof.
Figure 2:
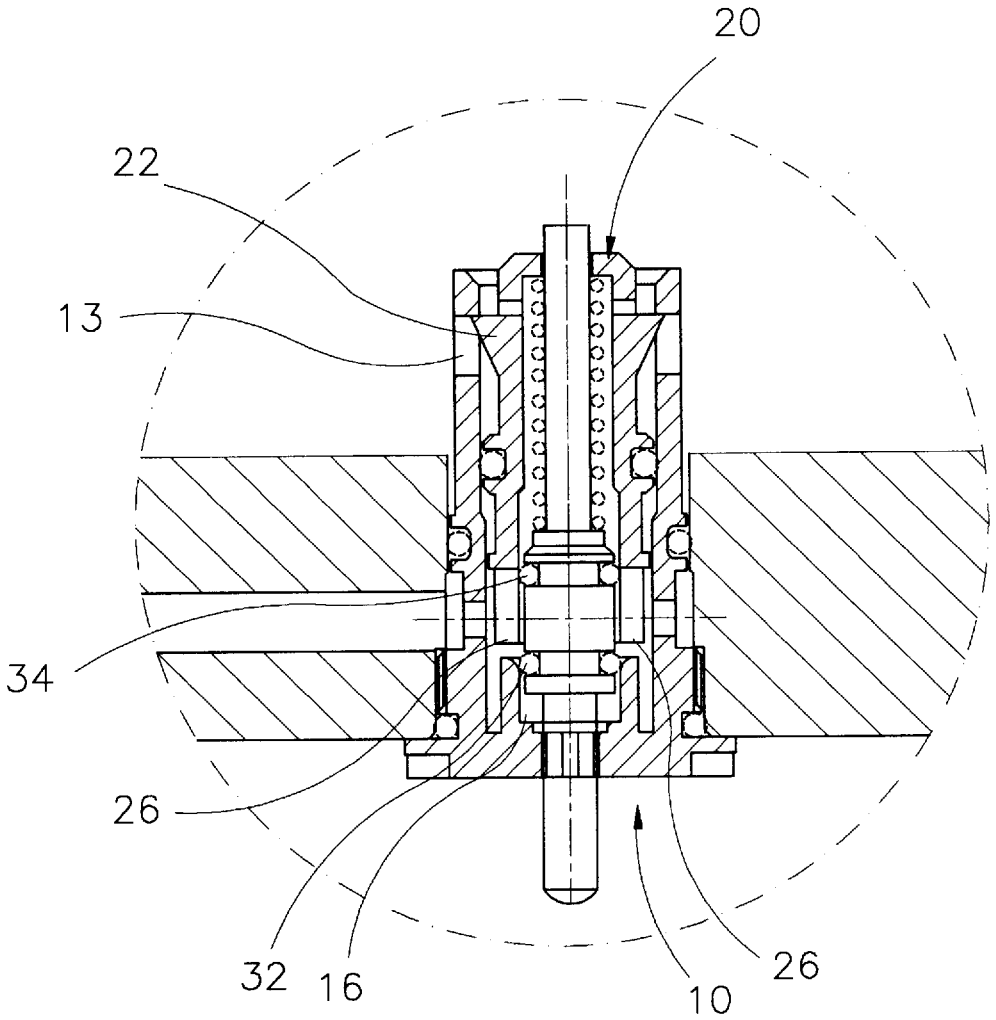
FIG. 2 is a sectional view of the present invention at the trigger point for ejecting a nail.
Figure 3:
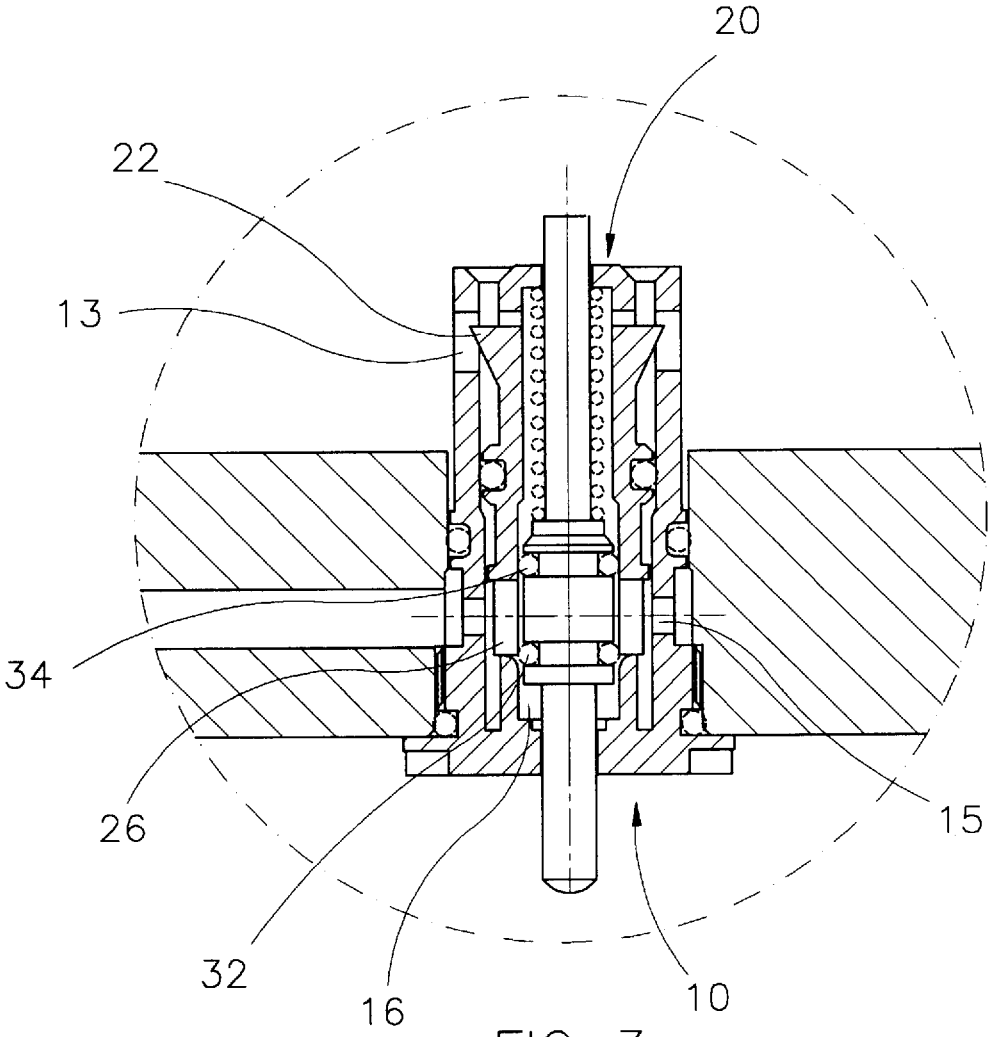
FIG. 3 and 3A are sectional views of the present invention, having entered the ejection state.
Figure 3A:
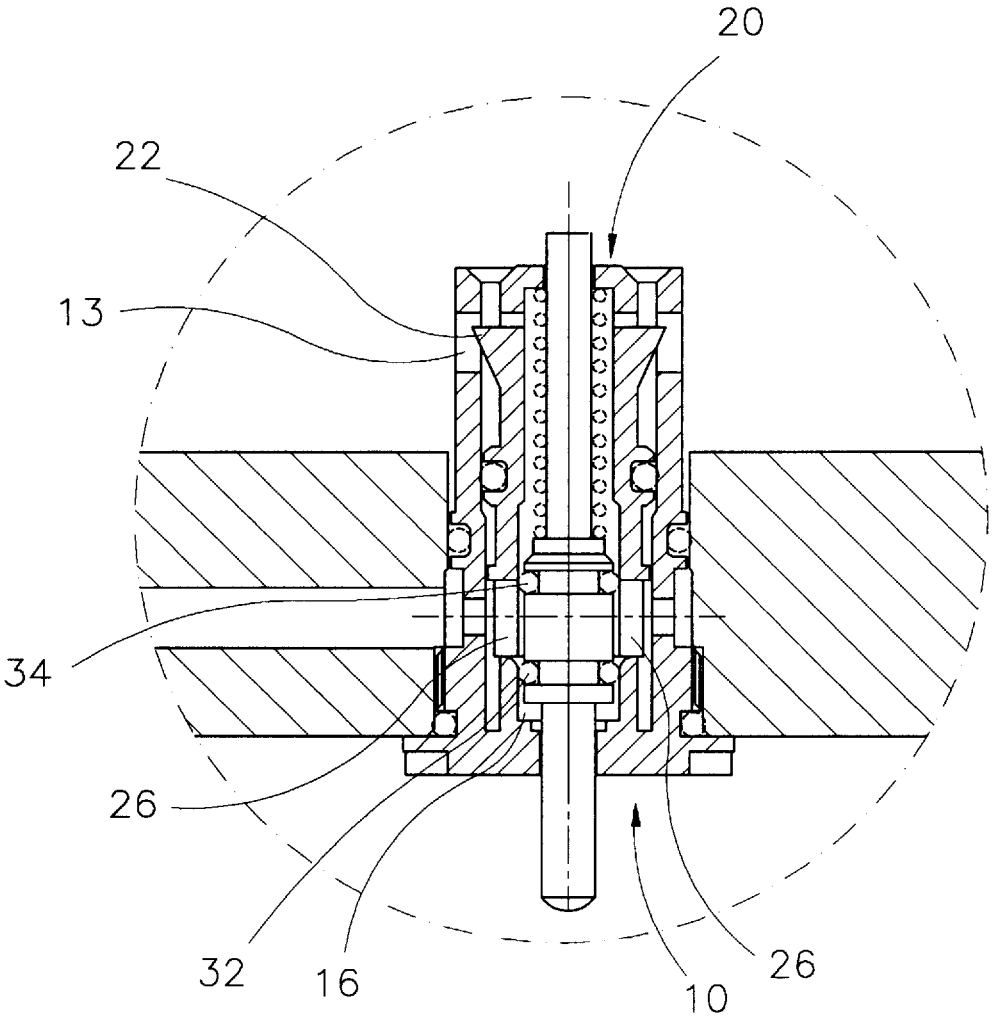
Figure 4:
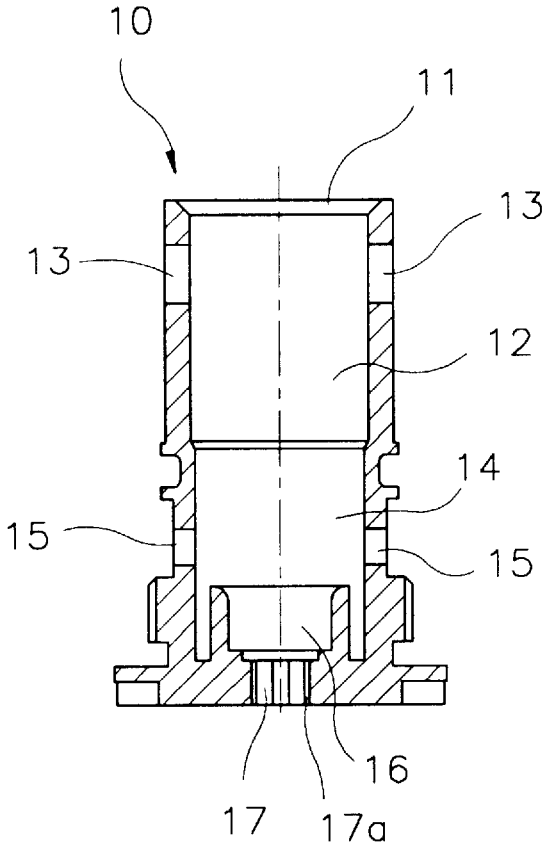
FIG. 4 is a sectional view of the valve seat of the present invention.
Figure 5:
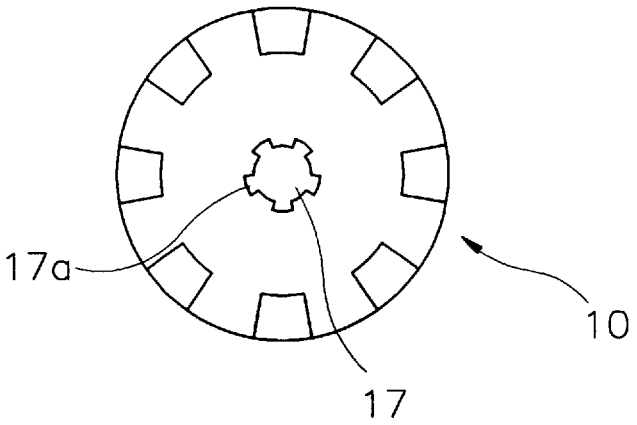
FIG. 5 is a top view of the valve seat of the present invention.

The ejection switch of the present invention controls the flow of compressed air from a compressed-air path 9 to and from a head valve of a pressure cylinder for ejecting a nail. As shown in FIGS. 1–3, the ejection switch of the present invention mainly comprises: a valve seat 10, to the upper side of which the compressed-air path 9 leads; a gliding seat 20; and a vertically movable moving bar 30. The moving bar 30 controls the flow of compressed air. In a lower position of the moving bar 30, in a loading state, compressed air is let into the head valve as a preparation for ejecting a nail. In a higher position of the moving bar 30, in an ejection state, compressed air is released from the head valve. The triggering of the loading state and of the ejection state follows the position of the moving bar 30 in a hysteresis-like behavior. This ensures accurate control of the ejection of nails.

Referring to FIG. 1–5, the valve seat 10 is a hollow, vertically extended, cylindrical body with an upper side, which is passed through by an inlet hole 11 for compressed air to enter, and a bottom. The valve seat 10 has a first cavity 12, extending downward from the upper side thereof, with a side wall, which has several first valve openings 13 for letting in compressed air. A second cavity 14 is located below the first cavity 12, having a side wall, which has several second valve openings 15. The second valve openings 15 connect to a connecting path 70, which leads to the head valve of the pressure cylinder. The valve seat 10 further has a lower end with a third cavity 16, in which the moving bar 30 is laid. The third cavity 15 has a side wall, a bottom, which is part of the bottom of the valve seat 10 and a first hole 17 in the bottom. The first hole 17 is connected to the third cavity 16, the second cavity 14 and the first cavity 12, all of them accommodating the gliding seat 20 and the moving bar 30. The first hole 17 has a periphery with many small openings 17*a* for releasing compressed air.

The moving bar 30 has an elongated shape, with a lower part 31 extending through the first hole 17 beyond the lower side of the valve seat 10. and gliding therein. Above the lower part 31, the moving bar 30 has a first sealing element 32. The first sealing element 32 leans against the side wall of the third cavity 16, if the moving bar 30 is in a low position (as shown in FIG. 1), or is located freely in the interior of the second cavity 14, if the moving bar 30 is in a high position (as shown in FIG. 3, with a transition shown in FIG. 2).

The moving bar 30 further has an upper part 33 and a second sealing element 34, placed below the upper part 33. The upper part 33 and the second sealing element 34 are located within the gliding seat 20, vertically gliding therein.

Referring to FIGS. 1–3 and 6–7, the gliding seat 20 is a hollow, elongated body of plastics or another elastic material with a top, a bottom and a peripheral wall. The gliding seat 20 has a lower part, which is glidingly mounted in the second cavity 14, and an upper part with a top hole 21 therein and two outward extending projections 22 below the top of the gliding seat 20. After assembling the ejection switch of the present invention, the top of the gliding seat 20 passes through the inlet hole 11, and the projections 22 extend into two of the first valve holes 13, allowing the gliding seat 20 to move vertically within the first and second cavities 12, 14 of the valve seat 10 by a certain distance.

Figure 6:
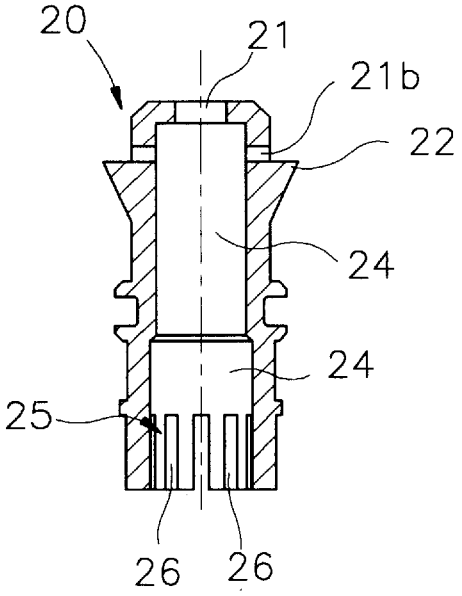
FIG. 6 is a sectional view of the valve seat of the present invention.
Figure 6A:
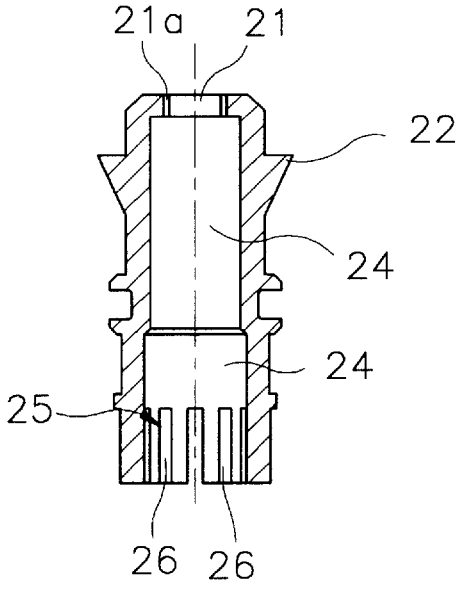
FIG. 6A is a sectional view of the valve seat of the present invention in another embodiment.
Figure 7:
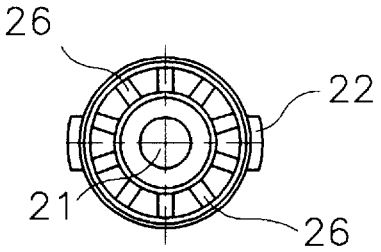
FIG. 7 is a top view of the valve seat of the present invention.

As shown in FIG. 6A, in another embodiment of the present invention, the top hole 21 has a periphery with many small openings 21*a* for allowing compressed air to enter the gliding seat 20.

Figure 6B:
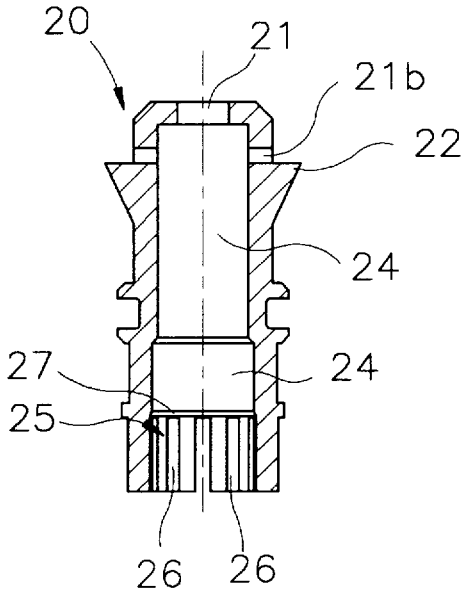
FIG. 6B is a sectional view of the valve seat of the present invention in a further embodiment.
Figure 9:
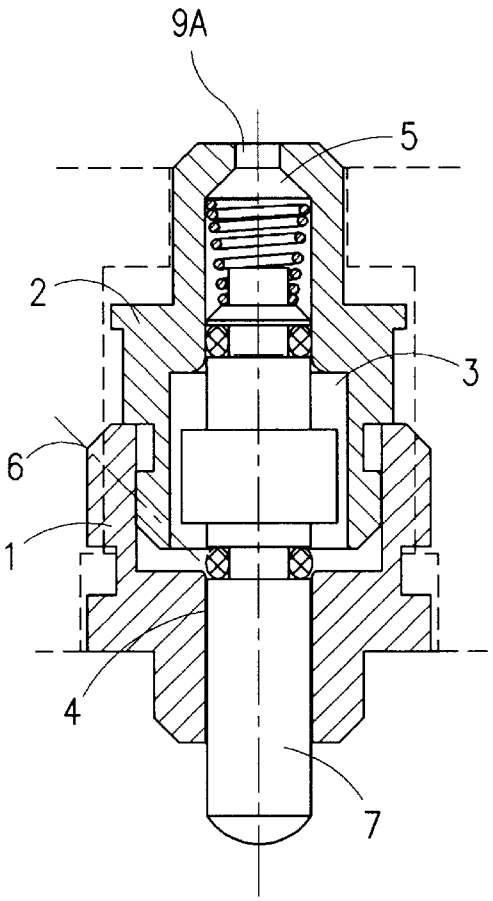
PRIOR ART FIG 9
FIG. 9 is a sectional view of a conventional ejection switch at the trigger point for ejecting a nail.
Figure 8:
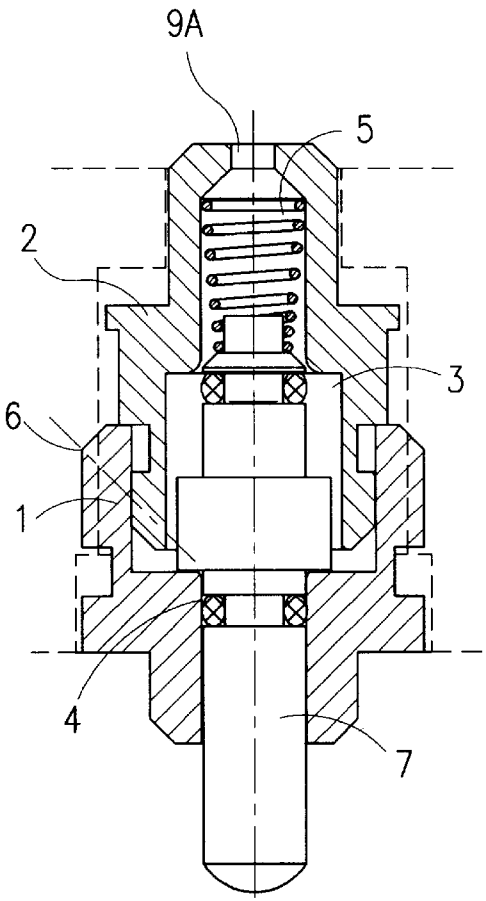
PRIOR ART FIG 8
FIG. 8 is a sectional view of a conventional ejection switch in the loading state.

As shown in FIG. 6B, in a further embodiment of the present invention, a plurality of small holes 21*b* pass through the side wall of the gliding seat 20 above the projections 22 for allowing compressed air to enter the gliding seat 20.

Since the inlet hole 11 and the first valves holes 13 are connected to compressed air, the gliding seat 20 is pressed down by compressed air from the compressed-air path 9. On the peripheral wall of the gliding seat 20, between the upper and lower parts thereof, a third sealing element 23 leans against the inner wall of the valve seat 10.

The inside of the gliding seat 20 forms a fourth cavity 24, in which the upper part 33 of the moving bar 30 is located. A spring 40 surrounds the upper part 33, pressing the gliding seat 20 upward against the moving bar 30. Close to the bottom of the gliding seat 20, the inside thereof forms a fifth cavity 25, which has many peripheral openings 26, connecting to the second cavity 14 of the valve seat 10 for letting in compressed air. As shown in FIGS. 1–3, depending on the vertical position of the moving bar 30, the fifth cavity 25 is sealed from the fourth cavity 24 by the second sealing element 34 or connected thereto.

In a high vertical position of the moving bar 30, in the ejection state, the first sealing element 32 is separated from the side wall of the third cavity 16, and the second sealing element 34 leans against the side wall of the fourth cavity 24. In this state, compressed air flows through the second cavity 14 into the head valve, and compressed air from the head valve enters the third cavity 16 through the peripheral openings 26 and flows out through the first hole 17, as shown in FIG. 3.

Referring to FIG. 6B, in the embodiment shown therein, the peripheral openings 26, which connect the fourth an fifth cavities 24, 25, have inclined side walls 27 for lengthening the lifetime of the second sealing element 34 and smooth operation thereof.

After compressed air has flown from the head valve in the ejection state, high pressure from the compressed-air path 9 pushes the gliding seat 20 down. For returning into the loading state, the moving bar 30 is moved down. Since the gliding seat 20 has been pushed down, the second sealing element 34 on the moving bar 30 allows compressed air to flow into the fifth cavity 25 for entering the loading state only after the first sealing element has closed the flow of compressed air into the third cavity 16.

As shown in FIGS. 1–3, by pushing the gliding seat 20 down during the ejection state and pushing the gliding seat 20 up during the loading state, the positions of the moving bar for triggering the ejection state and the loading state are not the same. Entering the ejection and loading states rather follows the position of the moving bar in a hysteresis-like behavior. Thus the ejection and loading states are stable, especially unintended ejecting of nails ia avoided, while the structure of the ejection switch remains simple. The valve seat 10, the gliding seat 20 and the moving bar 30 form a module that is easy to assemble. Therefore production cost of the ejection switch of the present invention is low.

I claim:

1. An ejection switch for a nailer, leading compressed air from a compressed-air path to a head valve of a pressure cylinder in a loading state for preparing an ejection of a nail or releasing compressed air from said head valve in an ejection state for ejecting said nail, said ejection switch comprising:

a valve seat, which is a hollow, vertically extended, cylindrical body with an upper side and a lower side, mounted on said nailer, said valve seat further comprising an inlet hole in said upper side, a first cavity next to said upper side, connected to said inlet hole, having a side wall with a plurality of first valve openings, a second cavity below said first cavity, having a side wall with a plurality of second valve openings, which lead to said head valve, a third cavity next to said lower side with a side wall, and a first hole in said lower side, leading to said third cavity;

a gliding seat, which is a hollow, vertically extended, cylindrical body, made of plastics or another elastic material, vertically glidingly mounted in said valve seat, sealed against said valve seat by a peripheral third sealing element, further comprising an upper end with a top hole, which is connected to said compressed-air path, two outward projections, extending into two first valve openings of said plurality of first valve openings, a fourth cavity next to said top hole, a fifth cavity below said fourth cavity with a side wall, and a lower end next to said fifth cavity with a plurality of peripheral openings; and a moving bar, which is a vertically extended bar, gliding in said valve seat and said gliding seat with a vertical position, having a lower part located in said third cavity and extending beyond said first hole of said valve seat and a top part within said fourth cavity of said gliding seat, with a first sealing element above said lower part leaning against said side wall of said third cavity or being freely located in said second cavity, depending on said vertical position, and a second sealing element below said top part being freely located in said second cavity or leaning against said side wall of said fifth cavity depending on said vertical position, and with a spring mounted inside said fourth cavity, pushing up said gliding seat against said moving bar;

wherein in said ejection state, said vertical position of said moving bar is high, said second sealing element seals said top hole, compressed air is released through said first hole, and said gliding seat is pushed down by compressed air from said compressed-air path, such that, when said moving bar moves down for entering said loading state, said second sealing element leaves said fifth cavity only after said first sealing hole has entered said third cavity, and triggering of said loading state and of said ejection state follows said vertical position of said moving bar in a hysteresis-like behavior, making ejecting nails easier to control.

2. An ejection switch for a nailer according to claim 1, wherein said top hole of said gliding seat has a plurality of peripheral small openings.

3. An ejection switch for a nailer according to claim 1, wherein said gliding seat has a plurality of small peripheral holes above said projections.

4. An ejection switch for a nailer according to claim 1, wherein said peripheral openings of said lower end of said gliding seat have upper ends with inclined surfaces.

* * * * *